US005249111A

United States Patent [19]

Richardson

[11] Patent Number: 5,249,111

[45] Date of Patent: Sep. 28, 1993

[54] REFLECTOR FOR USE WITH SPOTLIGHT

[75] Inventor: Brian E. Richardson, San Jose, Calif.

[73] Assignee: Morpheus Lights, Inc., San Jose, Calif.

[21] Appl. No.: 753,282

[22] Filed: Aug. 30, 1991

[51] Int. Cl.[5] ..... F21V 7/00

[52] U.S. Cl. ..... 362/302; 362/304; 362/342; 362/347

[58] Field of Search ..... 362/302, 303, 304, 305, 362/342, 347, 61

[56] References Cited

U.S. PATENT DOCUMENTS

| | | | |
|---|---|---|---|
| 657,693 | 9/1900 | Egnell | 362/302 |
| 1,309,449 | 7/1919 | Otte | 362/303 |
| 1,409,413 | 3/1922 | Ross | 362/61 |
| 1,478,898 | 12/1923 | Hachman | 362/61 |
| 1,480,904 | 1/1924 | Halvorson | 362/305 |
| 1,675,731 | 7/1928 | Schofield | 362/61 |
| 1,791,718 | 2/1931 | Dye et al. | 362/61 |

FOREIGN PATENT DOCUMENTS

| | | | |
|---|---|---|---|
| 833631 | 3/1952 | Fed. Rep. of Germany | 362/342 |
| 835884 | 4/1952 | Fed. Rep. of Germany | 362/342 |
| 846401 | 8/1960 | United Kingdom | 362/342 |

*Primary Examiner*—Carroll B. Dority
*Attorney, Agent, or Firm*—Skjerven, Morrill, MacPherson, Franklin & Friel

[57] ABSTRACT

A reflector includes a plurality of cylindrical bands having reflective outer surfaces and arranged about a common axis. The bands are sized and spaced such that, when mounted in front of a convergent beam spotlight, they prevent the rays of light from converging at a point so as to generate an intense heat which could damage a filter material, for example.

4 Claims, 7 Drawing Sheets

REFLECTOR FOR USE WITH SPOTLIGHT

FIELD OF THE INVENTION

The present invention relates to light projectors and more specifically to reflectors useful for altering the direction of light rays produced by a spotlight.

BACKGROUND OF THE INVENTION

FIGS. 1 and 2 are cross-sectional views of a conventional spotlight assembly. Lamp 6, which is a type of lamp known as a "Par-64", is connected to one end of a hollow "ParCan" housing 4. A light beam 5 passes from lamp 6 along optical axis OA through housing 4 and intercepts a plane-of-media Pm normal to axis OA. The region around plane Pm is commonly used for holding light filters or other optical elements (not shown in FIG. 1).

Lamp 6 has a clear cover glass 9. FIG. 2 shows a lamp 7 which is similar to lamp 6 but has a diffuser 9*d* which provides a wider beam. Lamps 6 and 7 are sealed-beam units which have to be replaced when they are worn out or when a different beam size is desired.

An improvement over lamps 6 and 7 is described in U.S. Pat. No. 4,855,884, which is assigned to the assignee of the present invention and which is incorporated herein by reference. The stage light therein described contains a reflector which is adjustable so as to vary the width of the beam produced by the light. The reflector and housing are permanent and need not be replaced when the light bulb is worn out. When the reflector is adjusted to a state of minimal curvature (shown in FIG. 2A of U.S. Pat. No. 4,855,884) the light rays are emitted in a substantially parallel pattern, as shown in FIG. 1 hereof. As the curvature of the reflector is increased through a range of tighter, elliptical shapes, a configuration such as is shown in FIG. 3 is produced. Elliptical reflectors have the characteristics of reflecting light from one focal point to a second focal point. Thus, as shown in FIG. 3, rays emanating from a first elliptical focal point Fl are reflected to a second elliptical focal point F2 where they cross and diverge.

When the light beam is focused in this way, a temperature extreme is created at point F2. As FIG. 3 shows, in a worst case this temperature extreme can coincide with plane Pm, where light filters or other optical elements may be located. If gelatin or plastic filter media susceptible to high temperature are positioned at or near plane Pm, then those media may fade, deteriorate, or possibly melt.

Accordingly, there is a need for a device which will avoid the extremely high temperatures which can be generated when a lamp such as the improved lamp described in U.S. Pat. No. 4,855,884 produces the convergence of light rays illustrated in FIG. 3.

SUMMARY OF THE INVENTION

According to this invention, a series of cylindrical bands having reflective outer surfaces are positioned concentrically about an optical axis of a light beam generated by a spotlight. The series of bands is placed at a location between the spotlight and the focal point at which its beam converges. The cylindrical reflective bands have different respective diameters which determine the radial spacing between them.

A reflector of this invention has the advantage that it eliminates the focal point and accompanying temperature extremes which otherwise would be produced by the converging rays of the light beam.

These and other advantages of the invention will become more apparent through a reading of the detailed description as illustrated in the drawings.

DETAILED DESCRIPTION OF THE INVENTION

Figure 1:
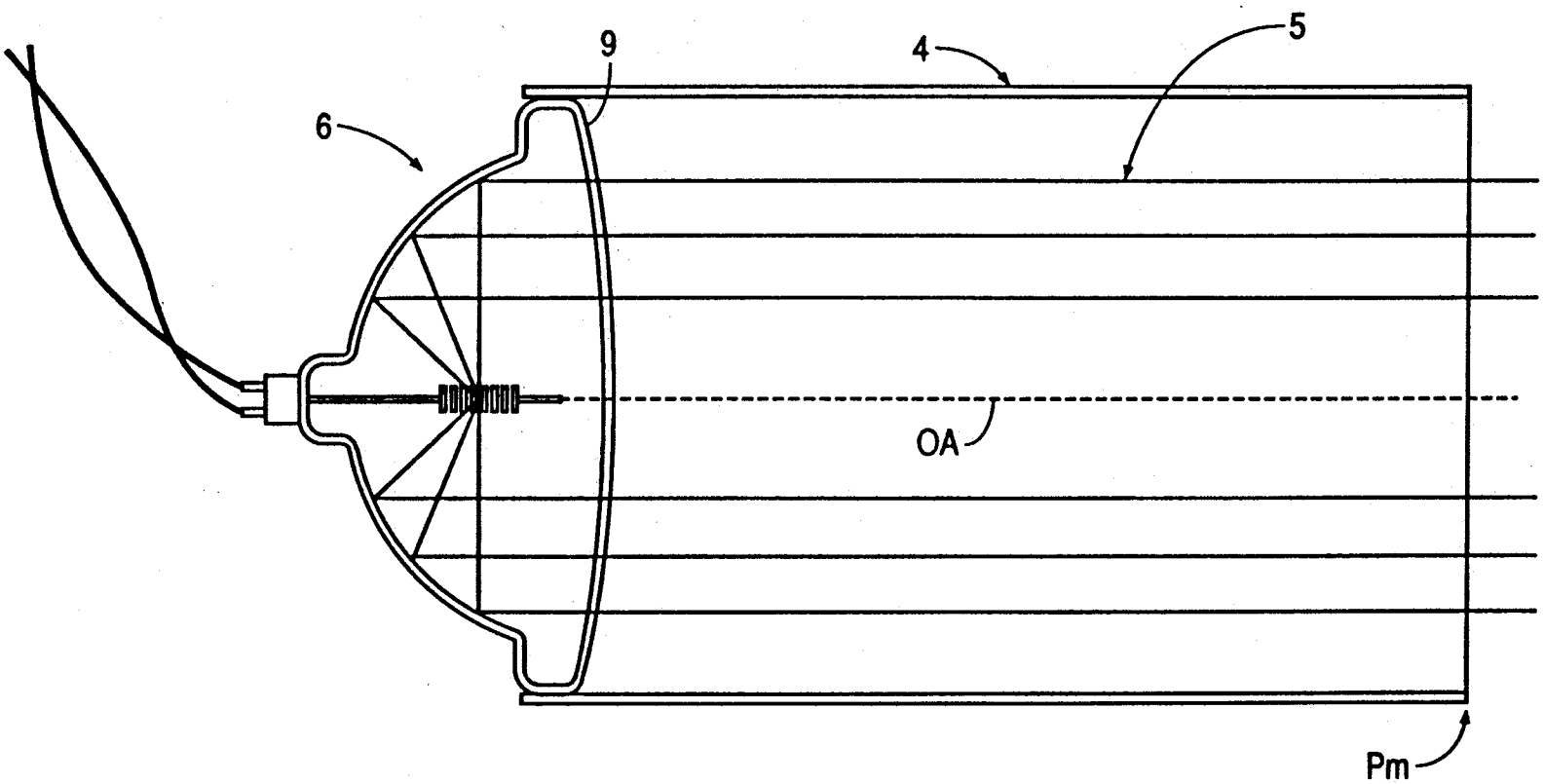
FIG. 1 (PRIOR ART)
FIG. 1 is a cross-sectional view of a conventional sealed-beam lamp.
Figure 2:
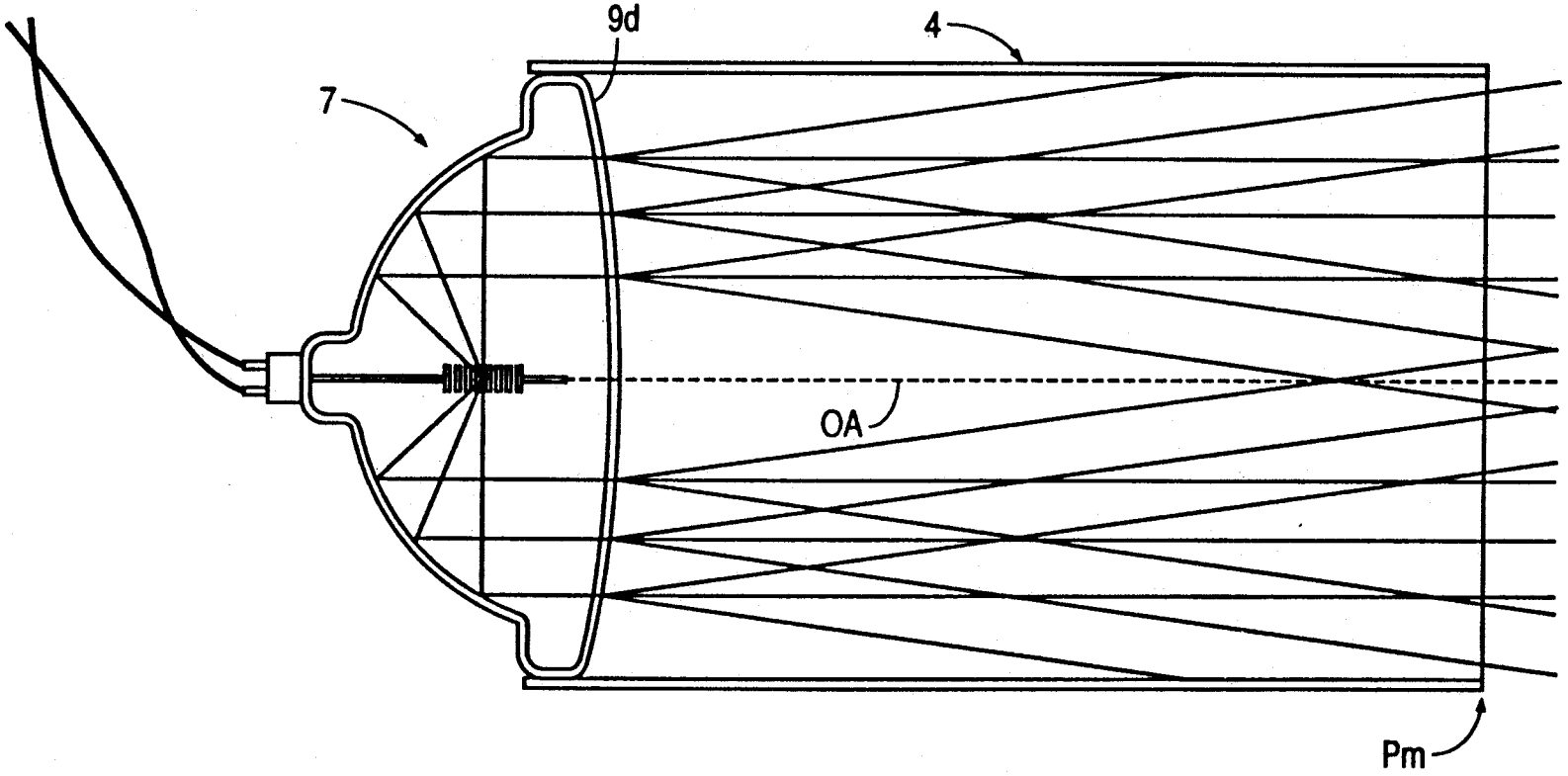
FIG. 2 (PRIOR ART)
FIG. 2 is a view similar to that shown in FIG. 1, except that the lamp has a diffuser.
Figure 3:
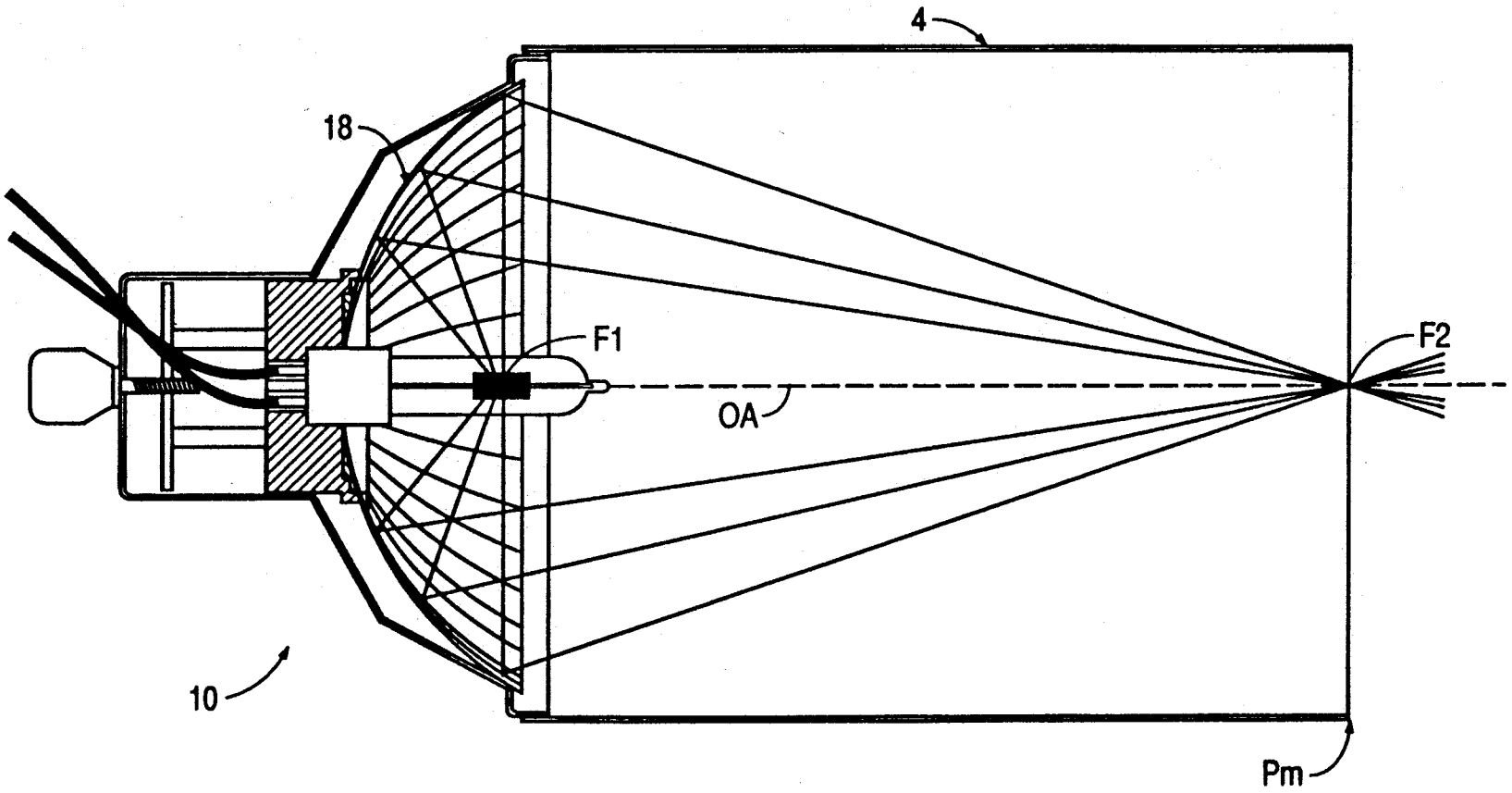
FIG. 3 (PRIOR ART)
FIG. 3 is a cross-sectional view of a focusable elliptical reflector of the kind described in U.S. Pat. No. 4,855,884.
Figure 4:
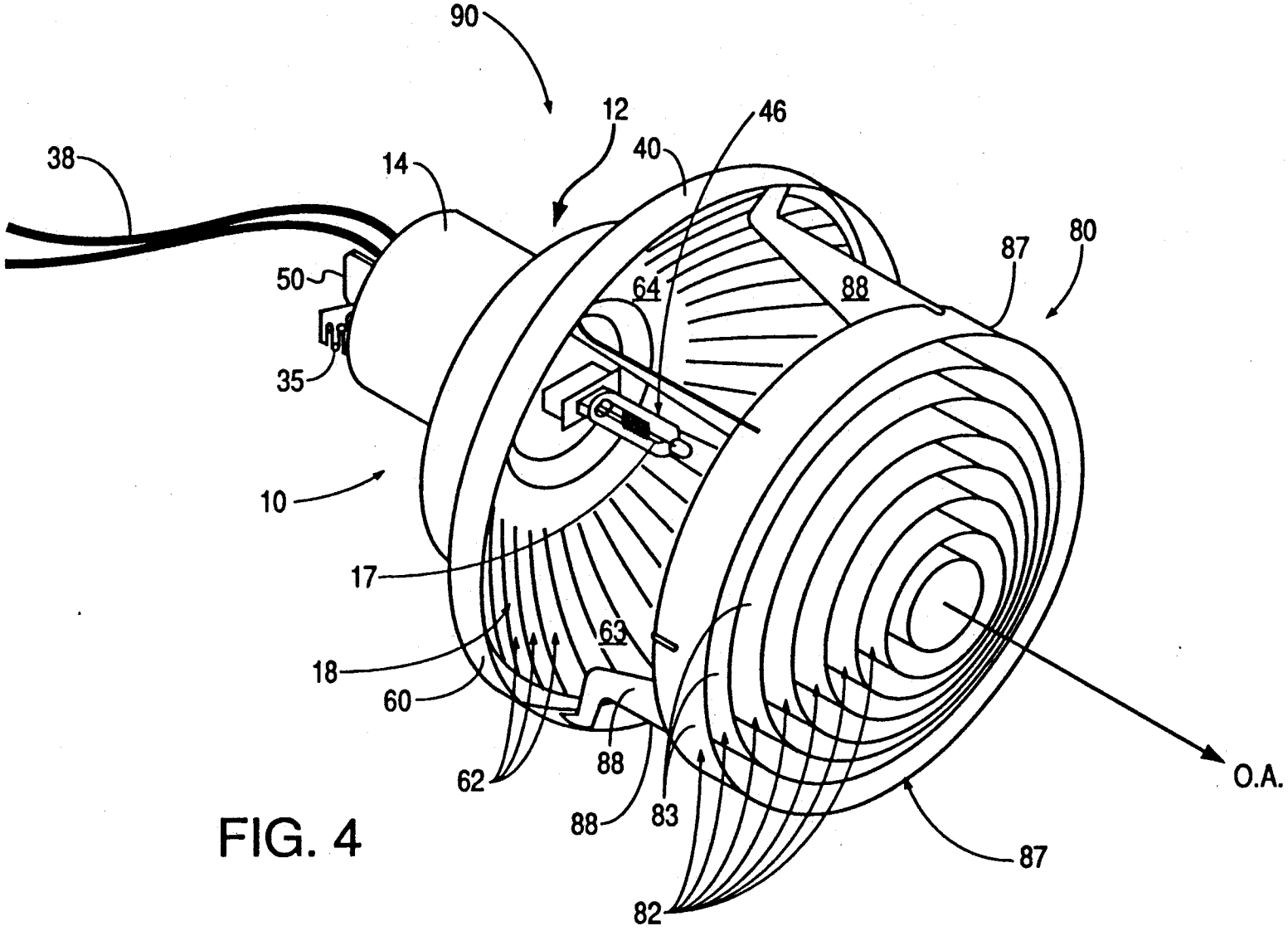
FIG. 4 is a perspective view of a spotlight together with a reflector in accordance with the invention.

FIG. 4 shows a reflector 80 in accordance with the invention positioned in front of a lamp 10 which is an adjustable reflector lamp of the kind described in U.S. Pat. No. 4,855,884. Reflector 80 and lamp 10 together form a projector 90 which is typically connected to a housing (not shown) similar to housing 4 in FIG. 3.

Lamp 10 comprises a casing 12 with a cap 14 in the back and a shell 40 in the front which receives a focusable elliptical reflector 18. Reflector 18 has a central area 64 with reflective leaves 62 extending concavely through a peripheral area 63 around the optical axis OA of lamp 10.

Figure 5:
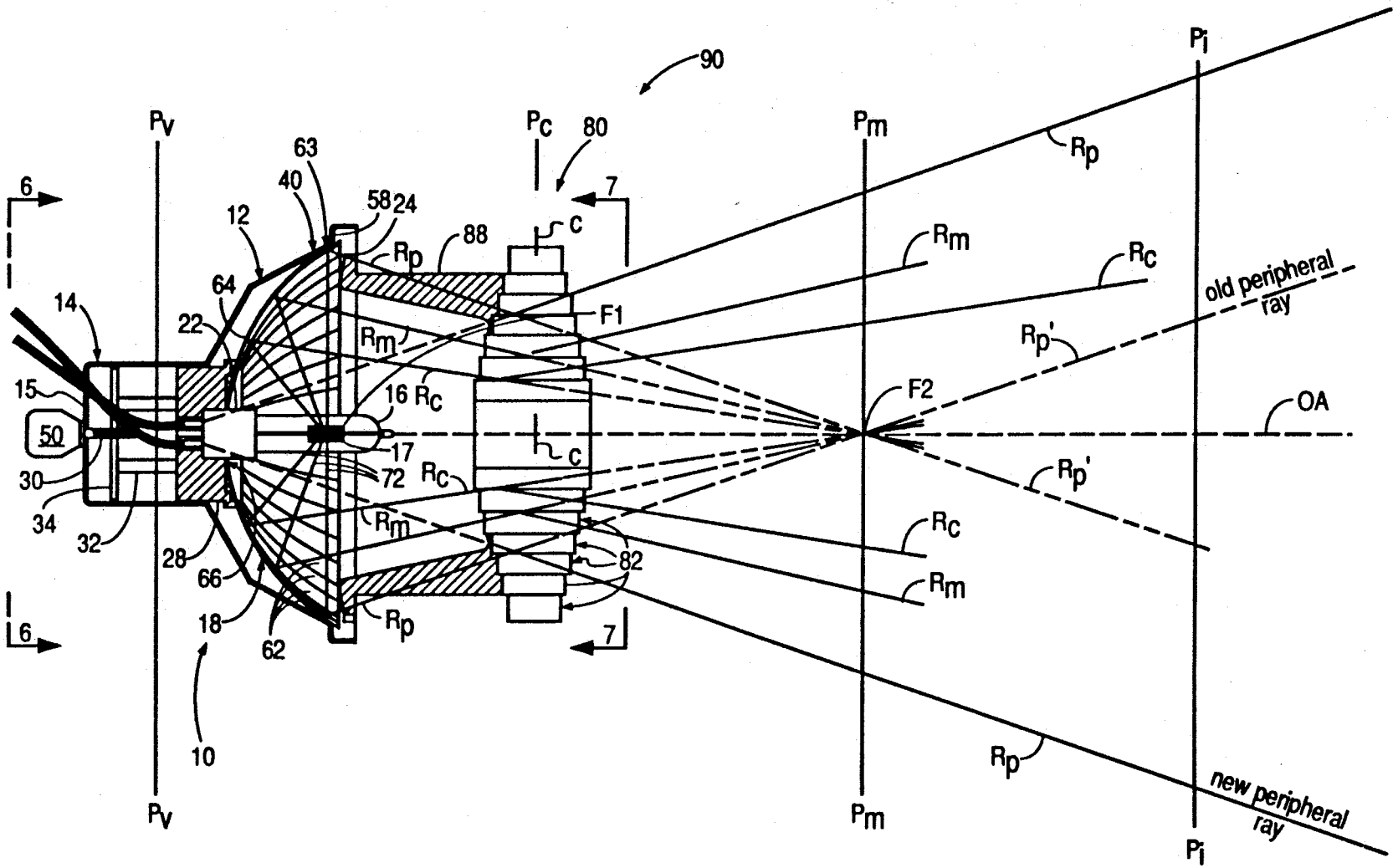
FIG. 5 is a cross-sectional view of the lamp and reflector shown in FIG. 4.
Figure 6:
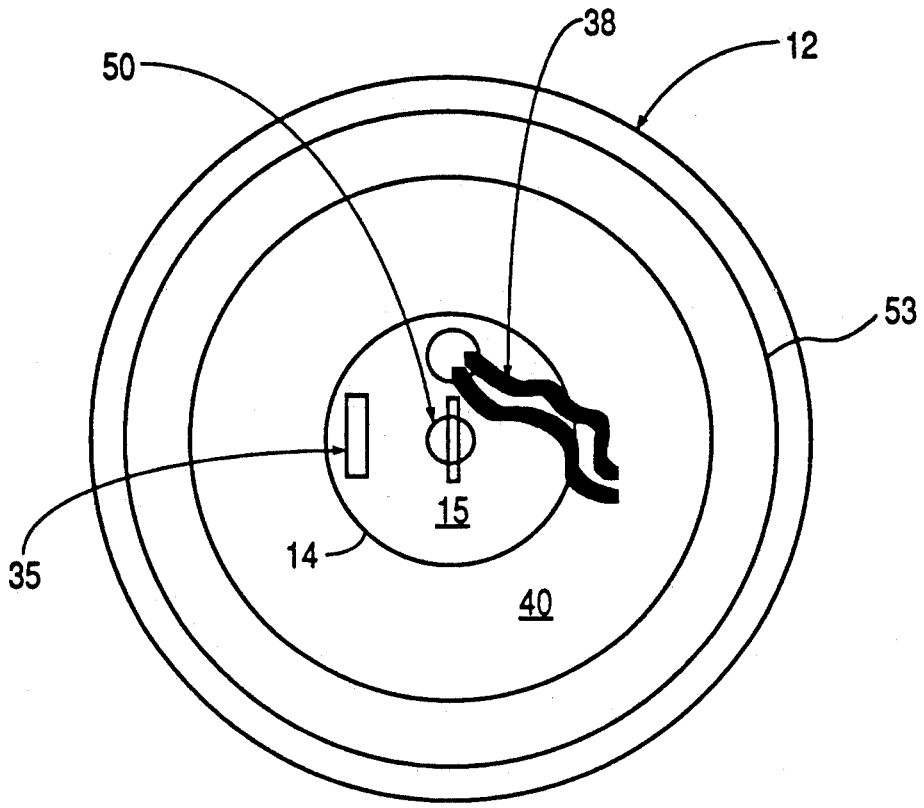
FIG. 6 is a view from the position designated by arrows 6—6 shown in FIG. 5.

FIG. 5 is a cross-sectional view in a plane along axis OA. Around an axial aperture 66 leaves 62 are clamped on their concave sides by a plate 24 and on their convex sides by a base 28. At their outer ends leaves 62 are restrained by a flange 58. Base 28 seats a socket 22 (preferably two-pin G9.5 type) which holds a replaceable bulb 16 with a filament 17 near a first focal point F1. Base 28 is slidable inside end cap 14, but rigidly connected through struts 32 to a screw-plate 34. A screw 30 with a knob 50 is constrained axially in an opening in an end plate 15 of cap 14 and is reversibly rotatable to displace screw-plate 34 and move bulb 16 reciprocally along axis OA. Turning knob 50 counter-clockwise extends screw-plate 34 and base 28 toward flange 58 and reduces the curvature of leaves 62. Turning knob 50 clockwise retracts base 28 into cap 14 while flange 58 increases the curvature of leaves 62. Screw-plate 34 preferably has an extension forming a tab 35 parallel to axis OA which extends through end plate 15 (see FIGS. 4 and 6) and has gauge marks (not shown) to indicate displacements of reflector 18 and its focus along axis OA.

Referring to FIG. 4, reflector 80 includes a series of thin-walled cylindrical reflective bands 82, each with a different diameter and positioned co-axially from lamp 10 by a "spider" structure having legs 88 attached to shell 40 by rivets or otherwise. Legs 88 extend to meet the outermost of bands 82, where they turn to form spokes 86 (see FIG. 7).

Figure 7:
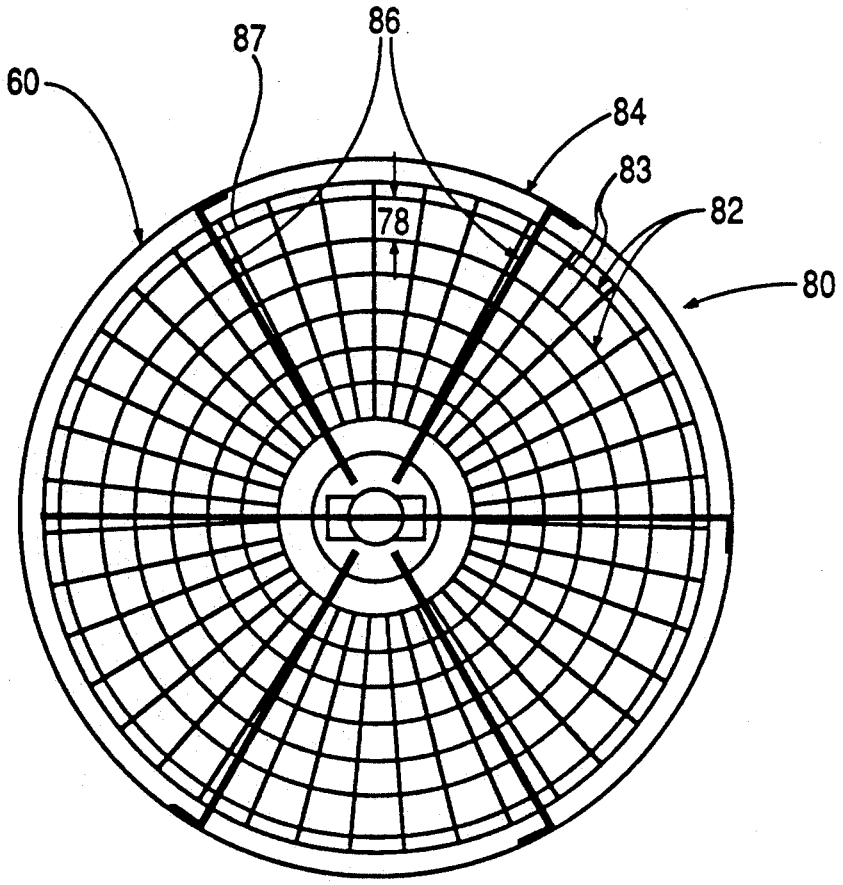
FIG. 7 is a view from the position designated by arrows 7—7 shown in FIG. 5.

FIG. 7 is a view along optical axis OA (in the direction of arrows 7—7 shown in FIG. 5) through concentric cylindrical reflector 80 into lamp 10. Six spokes 86 maintain the spacings between concentric bands 82.

As FIG. 5 shows, reflector 18 focuses light in rays Rp from its peripheral area 63 at steeper angles with respect to axis OA than rays Rc from its central area 64. Rays Rm are between rays Rp and Rc. Reflector bands 82 are separated by uniform radial spacings and have axial widths which vary inversely with their diameters. Since all of rays Rp, Rm and Rc are incident on the outside of bands 82, it is not necessary that the inner surfaces of bands 82 be reflective. As shown in FIG. 5, bands 82 have their centerpoints aligned in a plane Pc which is normal to axis OA. However, this is not critical. Bands 82 could be aligned in various ways.

The width of bands 82 depends on the radial spacing between them. Generally speaking, as the spacing between bands 82 increases, their width also increases. Moreover, assuming that the radial spacing between the bands is equal, the central bands will be wider than those near the periphery of reflector 80. If the bands are too wide (or the spacing too small) some of the light rays will be reflected against the non-reflective inner surface of the next larger band. If the bands are too narrow (or the spacing too large) some of the light rays will not be reflected at all and will reach focal point F2 in FIG. 5. The design of reflector 80 must take all of these factors into account.

In an alternative embodiment, co-axial "bands" could be formed in a concave shape with vertices downstream. In such an arrangement, converging rays Rp, Rm and Rc would be reflected less divergently.

Preferably, reflector 18, casing 12 and reflector 80 are each formed of aluminum. Other metals, such as stainless steel may also be used for reflector 80. Bulb 16 is preferably a type ANSI FEL(22) part No. FEL-Q1000/4CL from General Electric Co., or FEL B8 from Philips Co. Since only bulb 16 needs to be replaced, maintenance costs are less than for conventional sealed-beam, fixed-reflector lamps.

When lamp 10 is operated, light rays 72 emitted by filament 17 are reflected off reflector leaves 62 and focused as rays Rp, Rm and Rc towards focal point F2. These rays converging along axis OA Pc intersect the highly reflective outer surfaces of bands 82 at plane and are mirrored symmetrically along axis OA as diverging rays. This eliminates the convergence of rays Rp, Rm and Rc at focal point F2 and eliminates as well regions of intensified beam strength between planes Pc and Pi on both sides of F2, as shown in FIG. 5.

FIG. 5 provides a comparison between the light beams transmitted with and without reflector 80. By comparing the peripheral rays Rp of the arrangement including reflector 80 with the peripheral rays Rp' of the arrangement without reflector 80, it is apparent that the light beam diverges at the same rate whether or not reflector 80 is present. While the width of the beam with reflector 80 is somewhat greater than the width of the beam without reflector 80, this difference is not significant. By extending rays Rp (after they pass through reflector 80) backward (see hatched lines), it can be seen that the light beam will appear to a downstream observer as if it were emanating from a point on plane Pv instead of from point F2 on plane Pm. Most importantly, the rays emitted by bulb 16 never converge at or near a single point or plane and thus no hot spots injurious to filter media are created.

While the invention has been described in terms of a preferred embodiment, it will be appreciated that it may be embodied otherwise without departing from its essence. It is therefore intended that the following claims be interpreted as covering any modifications falling within the true spirit and scope of the invention.

I claim:

1. An arrangement comprising a spotlight and a reflector, said reflector being mounted in front of said spotlight, said spotlight containing a reflective element which causes light rays from said spotlight to converge at or near a point in space, said reflector comprising a plurality of bands, each of said bands being formed in the shape of an open-ended cylinder with a reflective outer surface and having a diameter different from the respective diameters of the others of said bands, said bands being positioned coaxially, each of said bands having a width, the width and diameter of each of said bands being selected such that said light rays from said spotlight strike said reflective outer surfaces of said bands and are thereby prevented from converging at or near said point in space.

2. The arrangement of claim 1 wherein said spotlight includes an elliptical reflector.

3. The arrangement of claim 2 comprising a filter medium positioned at said point in space, said filter medium being subject to damage by high temperatures.

4. The arrangement of claim 1 wherein each of said bands has an edge facing said spotlight, and wherein said bands are sized and positioned such that a converging light ray from said spotlight which passes just inside an edge of one of said bands is reflected from the outer surface of the next smaller of said bands and a converging light ray which is reflected from the reflective outer surface of one of said bands do not strike the next larger of said bands.

* * * * *

UNITED STATES PATENT AND TRADEMARK OFFICE

CERTIFICATE OF CORRECTION

PATENT NO. : 5,249,111

DATED : September 28, 1993

INVENTOR(S) : Brian E. Richardson

It is certified that error appears in the above-indentified patent and that said Letters Patent is hereby corrected as shown below:

Column 4, line 50, delete "do" and insert --does--.

Signed and Sealed this

Fifth Day of April, 1994

Bruce Lehman

*Attest:*

BRUCE LEHMAN

*Attesting Officer*

*Commissioner of Patents and Trademarks*